US010978015B2

(12) United States Patent
Chen

(10) Patent No.: US 10,978,015 B2
(45) Date of Patent: Apr. 13, 2021

(54) ADJUSTING METHOD AND DEVICE FOR GATE OFF VOLTAGE AND DISPLAY DEVICE

(71) Applicants: HKC Corporation Limited, Shenzhen (CN); Chongqing HKC Optoelectronics Technology Co., Ltd., Chongqing (CN)

(72) Inventor: Yu-Jen Chen, Chongqing (CN)

(73) Assignees: HKC Corporation Limited, Shenzhen (CN); Chongqing HKC Optoelectronics Co., Ltd., Chongqing (CN)

( * ) Notice: Subject to any disclaimer, the term of this patent is extended or adjusted under 35 U.S.C. 154(b) by 0 days.

(21) Appl. No.: 16/610,862

(22) PCT Filed: Jun. 16, 2017

(86) PCT No.: PCT/CN2017/088739

§ 371 (c)(1),
(2) Date: Nov. 4, 2019

(87) PCT Pub. No.: WO2018/201569

PCT Pub. Date: Nov. 8, 2018

(65) Prior Publication Data

US 2020/0365103 A1 Nov. 19, 2020

(30) Foreign Application Priority Data

May 5, 2017 (CN) ..... 201710313547.0

(51) Int. Cl.
*G09G 3/36* (2006.01)

(52) U.S. Cl.
CPC ..... *G09G 3/3648* (2013.01); *G09G 2320/066* (2013.01); *G09G 2320/0626* (2013.01); *G09G 2360/14* (2013.01)

(58) Field of Classification Search
CPC ..... G09G 3/3648; G09G 2320/0626; G09G 2320/066; G09G 2360/14
See application file for complete search history.

(56) References Cited

U.S. PATENT DOCUMENTS

2005/0258341 A1* 11/2005 Nishikawa ..... G01J 1/46 250/214.1
2014/0168236 A1* 6/2014 Keefe ..... G09G 3/3406 345/520
2016/0098960 A1* 4/2016 Park ..... G09G 3/3233 345/205

* cited by examiner

*Primary Examiner* — Robert J Michaud
(74) *Attorney, Agent, or Firm* — Wang Law Firm, Inc.

(57) ABSTRACT

Embodiments of the present disclosure disclose a method, a device and a display apparatus for adjusting a gate-off voltage. In that the method for adjusting the gate-off voltage includes: obtaining a contrast of the display brightness of the display panel by at least one photosensitive element; comparing the contrast with an initial contrast, and if the difference between the contrast and the initial contrast is greater than the set threshold value, adjusting the gate-off voltage.

18 Claims, 8 Drawing Sheets

ADJUSTING METHOD AND DEVICE FOR GATE OFF VOLTAGE AND DISPLAY DEVICE

CROSS-REFERENCE TO RELATED APPLICATION

This application is a National Stage Application of PCT International Patent Application No. PCT/CN2017/088739 filed on Jun. 16, 2017, under 35 U.S.C. § 371, which claims priority to and the benefit of Chinese Patent Application No. 201710313547.0, filed on May 15, 2017, the disclosures of which are incorporated herein in their entirety by reference.

BACKGROUND OF THE INVENTION

1. Field of the Invention

The embodiments of the present disclosure relate to the field of display driving technology, and more particularly, to a method, a device and a display apparatus for adjusting the gate-off voltage.

2. Description of the Related Art

Thin Film Transistor Liquid Crystal Display (TFT-LCD) is one of the main varieties of the flat panel display, which has become an important display platform in modern ITs and video products. The primary driving principle of TFT-LCD includes the following steps: the system board connects the R/G/B compression signal terminals and the control signal terminal to the connector on the control board (C-Board) through the wires. The data signals and control signals are transferred to the printed circuit board (PCB) through flexible flat cables after data signals and control signals are processed by the timing controller (TCON) on the C-Board, then connected to the display area through the source-chip on film (S-COF) and the gate-chip on film (G-COF), respectively, such that the data lines and the scan lines of the display area of the LCD may obtain the desired data signal and the gate driving signal, respectively.

Here, G-COF outputs the voltage for turning ON or OFF the thin film transistors (TFT) of the matrix substrate, but the transition characteristic of the TFT element served as the pixel switch may be changed with the time, that is, the relationship between the electron mobility and the gate voltage of TFT elements will be changed, thus the optimum gate-off voltage of the TFT element will also be changed after a period of time, so that the gate electrode will not be turned off thoroughly after a period of time, resulting in a decrease in the pixel display contrast of the display area of the TFT-LCD.

SUMMARY OF THE INVENTION

The present disclosure provides a method, a device and a display apparatus for adjusting the gate-off voltage to solve the problem in that the decrease in the pixel display contrast of the display area of the TFT-LCD resulting from incomplete turning-off of the gate electrode after a period of time.

Embodiments of the present disclosure provide a method for adjusting a gate-off voltage, which includes:

obtaining a contrast of a display brightness of a display panel; and comparing the contrast with an initial contrast, if a difference between the contrast and the initial contrast is greater than a set threshold value, then adjusting the gate-off voltage of the display panel.

Embodiments of the present disclosure further provide a device for adjusting the gate-off voltage, which includes:

a contrast detecting module configured to obtain a contrast of a display brightness of a display panel by at least one photosensitive element; and a voltage adjusting module connected to the contrast detecting module, configured to compare the contrast with an initial contrast, if a difference between the contrast and the initial contrast is greater than a set threshold value, the contrast detecting module is configured to adjust the gate-off voltage of the display panel.

Embodiments of the present disclosure further provide a display apparatus including a display panel, and the device for adjusting the gate-off voltage as described in any embodiment of the present disclosure.

The present invention provides a technical solution for obtaining a contrast of a display brightness of the display panel by at least one photosensitive element and comparing the contrast with an initial contrast of the display panel. If the difference between the contrast and the initial contrast is greater than the set threshold value, then the gate-off voltage of the display panel is adjusted. It is possible to solve the problem that the pixel display of the display panel is incompletely turned off as the operating time increases, resulting in a decrease in the pixel display contrast of the display area.

DESCRIPTION OF THE PREFERRED EMBODIMENTS

Figure 1A:
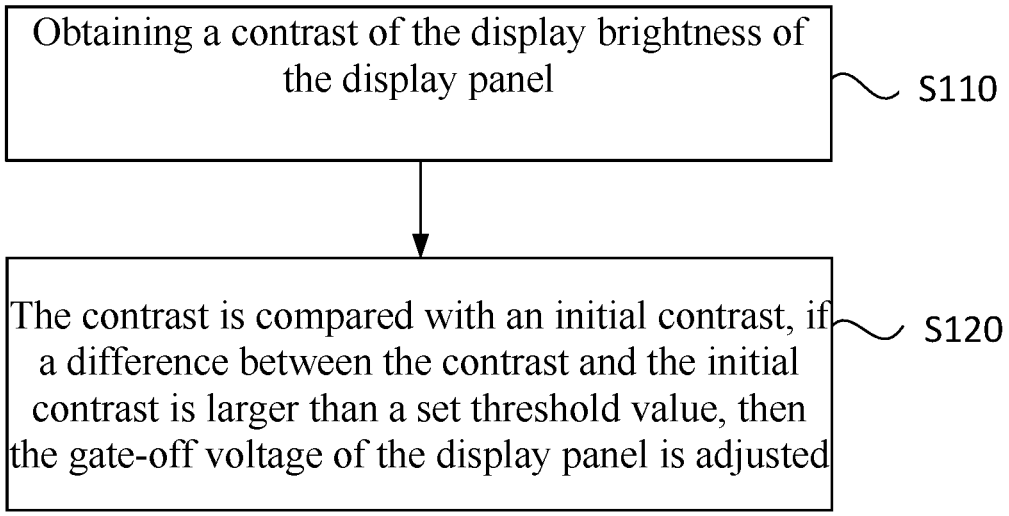
FIG. 1*a* is a flow chart of a method for adjusting the gate-off voltage provided by the embodiments of the present disclosure.

The present disclosure will now be described in further detail with reference to the accompanying drawings and embodiments. It is to be understood that the specific embodiments described herein are for the purpose of explaining the present disclosure and are not intended to limit the present disclosure. It is also to be noted that, for the sake of convenience of description, only portions of the present disclosure are shown in the drawings rather than the entire structure.

FIG. 1A is a flow chart of a method for adjusting the gate-off voltage provided by the embodiments of the present disclosure. The method of the present embodiment may be implemented by a device for adjusting the gate-off voltage. As shown in FIG. 1A, the method for adjusting the gate-off voltage provided by the present embodiment specifically includes step S110 to step S120.

In step S110, obtaining a contrast of the display brightness of the display panel.

Here, the display panel may be, for example, an LCD display panel, an OLED display panel, a QLED display panel, or other display panel.

TFTs served as pixel switches of the display panel, whose transition characteristic will be changed as operating time increases, in the present embodiment, the transition characteristic is the correspondence that the electron mobility varies as the variation of the gate voltage, the gate voltage values correspond to different electron mobilities, respectively. However, as the operating time increases, the electron mobility tends to vary in the TFT element while the gate voltage remains constant. By way of example, if the display panel has a gate voltage of V0 at the initial time when the electron mobility is minimum, if the gate voltage is still V0 after the display panel operates for a period of time, then the electron mobility will not be minimum.

Figure 1B:
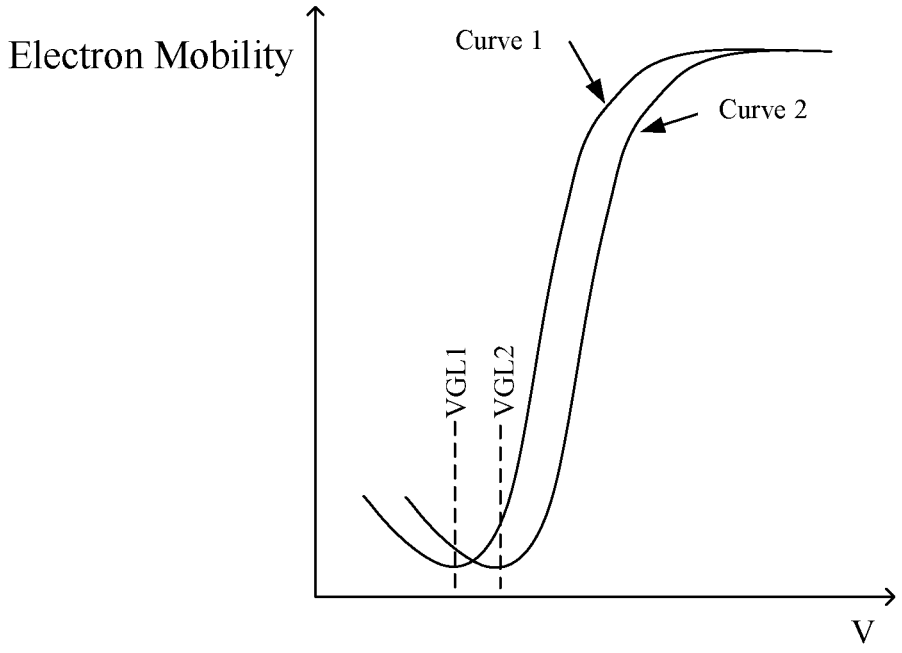
FIG. 1*b* is a transition characteristic graph of the TFT element provided by the embodiments of the present disclosure.

With reference to FIG. 1B, which is a transition characteristic graph of the TFT element. As shown in FIG. 1B, the transition characteristic curve of the TFT element is curve 1 at the initial time, and after a period of time T, the transition characteristic curve of the TFT element is curve 2, and the transition characteristic curve of the TFT element is shifted to the right.

The current should be as small as possible when the TFT element is turned off, because if the current remain large, it means that the TFT element is not turned off completely, causing the pixel electrode still being charged at that time, and the pixels are not able to stay in the dark state. The contrast is the ratio of the maximum and minimum values of the display brightness of the display panel. If the TFT element is incompletely turned off, then the minimum value of the display brightness of the display panel will increase, thus reducing the contrast of the display panel, and affecting the display quality of the display panel, such that the displayed image will be not clear.

Referring to FIG. 1B, the gate voltage (gate-off voltage) at the time when the current is minimum is VGL1 at the initial time, and after a period of the time, the gate voltage at the time when the current is minimum becomes to VGL1. The gate-off voltage of the TFT element of the display panel is a fixed value that has been set at the ex-factory time, and the contrast of the display panel gradually decreases over time, affecting the viewing effect and reducing the lifetime of the display panel.

In the embodiment of the present disclosure, the gate-off voltage of the TFT element is set for a plurality of times in accordance with the characteristic that the transition characteristic curve of the TFT varies with time. Firstly, the contrast of the display brightness of the display panel is obtained by at least one photosensitive element. The photosensitive element is able to measure and acquire the maximum and minimum values of the display brightness of the display panel, so as to obtain the contrast of the display panel.

Optionally, the photosensitive element may be disposed to collect the data of the display brightness at the time that the display panel initializes the display operation. The underlying reason is that, the system of the display apparatus switches to the darkest and brightest screens at the time that the display panel initializes the display operation, so as to facilitate the data collection of the photosensitive element, and the photosensitive element may be turned off to save power while the display panel is performing display operation, thus the purpose of power and operation saving may be achieved.

Alternatively, the photosensitive element may be one or more, and when the plurality of photosensitive elements is provided, the measurement result of each photosensitive elements may be integrated to obtain an accurate contrast of the display brightness of the display panel.

The photosensitive element may be a photosensitive resistor, a photosensitive optical fiber or an optical lens.

The photosensitive resistor is a resistor fabricated based on the photoconductive effect, whose resistance value varies as the intensity of the incident light, also known as the photoconductive detector. The resistance value decreases as the intensity of the incident light increases, and the resistance value increases as the intensity of the incident light decreases; alternatively, the resistance value decreases as the intensity of the incident light decreases, and the resistance value increases as the intensity of the incident light increases for another photosensitive resistor. In the present embodiment, the maximum and the minimum values of the display panel luminance are measured based on the relationship between the resistance value of the photosensitive resistor and the display brightness of the display panel, so as to obtain the contrast of the display panel.

The photosensitive optical fiber refers to an optical fiber that absorbs ultraviolet light, which may be observed from the ultraviolet light absorption spectrum of the optical fiber. The refractive index of the optical fiber is induced by the absorption for the ultraviolet light by the optical fiber, such that the spatial distribution changes with the intensity of the ultraviolet light, also referred as light-induced refractive index changes. The core of the photosensitive optical fiber is typically made by doping a few mole percentage of germanium or phosphorus in the quartz in order to increase the refractive index. In the present embodiment, the display brightness of the display panel may be obtained based on the change in the refractive index of the photosensitive optical fiber, so as to obtain the contrast.

The optical lens structure utilizes the optical imaging structure to simulate the spectral response and reception characteristics of the human eye, the brightness in the angle of the field of view is continuously monitored, so as to obtain the minimum and maximum display brightness of the display panel.

In step S120, the contrast is compared with an initial contrast, if a difference between the contrast and the initial contrast is greater than a set threshold value, then the gate-off voltage of the display panel is adjusted.

The contrast is compared with the initial contrast after the contrast of the display brightness of the display panel is obtained by at least one photosensitive element. Referring to FIG. 1B, if the gate-off voltage selected at the initial time is the optimum value VGL1, the initial time has an optimum contrast, i.e., the initial contrast described in this embodiment. If the difference between the measured contrast and the initial contrast is greater than the set threshold, the gate-off voltage of the display panel is adjusted so that the contrast is equal to the initial contrast, or is closer to the initial contrast. By way of example, with reference to FIG. 1B, the initial gate-off voltage is VGL1, and if the gate-off voltage is still VGL1 after the period of time T, the contrast of the display brightness of the display panel is reduced, and the gate-off voltage may be set as VGL2, such that the contrast of the display brightness of the display panel is equal to the initial contrast.

It is worth noting that the set threshold value is set to be as small as possible. Optionally, it can be set to 5% of the initial contrast so that the gate-off voltage may be adjusted in time.

On the basis of the above embodiment, when the gate-off voltage is adjusted, the measurement time can be directly obtained in accordance with the relationship between the electron mobility and the gate-off voltage, and the relationship between the electron mobility and the contrast of the display brightness, the contrast is the gate-off voltage of the initial contrast, and the gate-off voltage for driving the gate electrode to be short-circuit is then set to the gate-off voltage calculated at this time.

Alternatively, the gate-off voltage values for each gear are set directly depending on the relationship between the electron mobility and the contrast. Exemplary, the gate-off voltage may be set to a first mode at the time after the display panel operates for a period of time T, and the gate-off voltage may be set to a second mode at the time after the display panel operates for a period of time 2T. The specific gate-off voltage value depends on the characteristics of the transition characteristics of the TFT element over time.

The present invention provides a technical solution for obtaining a contrast of the display brightness of the display panel by the at least one photosensitive element, and comparing the contrast with the initial contrast of the display panel. If the difference between the contrast and the initial contrast is greater than the set threshold, the gate-off voltage of the display panel is adjusted. It is possible to solve the problem that the pixel display of the display panel is incompletely turned off as the operating time increases, resulting in a decrease in the pixel display contrast of the display area.

Figure 2A:
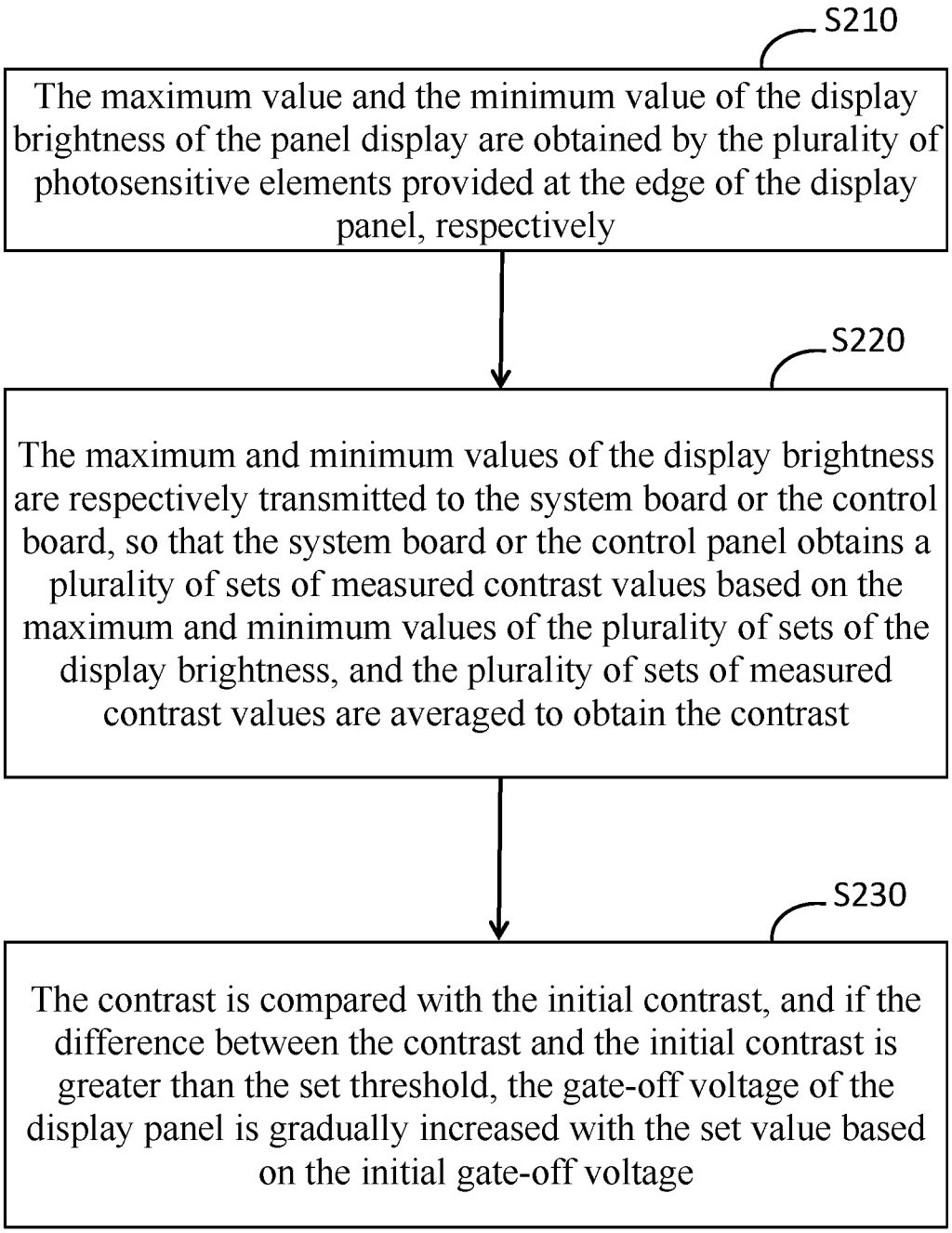
FIG. 2*a* is a flow chart of another method for adjusting the gate-off voltage provided by the embodiments of the present disclosure.

Referring to FIG. 2*a*, which is a flow chart of another method for adjusting the gate-off voltage provided by the embodiments of the present disclosure. A plurality of photosensitive elements are utilized in the method for adjusting the gate-off voltage, and specifically, the method for adjusting the gate-off voltage includes step S210

In step S210, the maximum values and the minimum values of the display brightness of the panel display are obtained by the plurality of photosensitive elements provided at the edge of the display panel, respectively.

The plurality of photosensitive elements are provided, each of which measures the maximum and minimum values of the display brightness of the display panel, the data of the display brightness measured by each of the photosensitive elements may be integrated to obtain an accurate contrast value.

Figure 2B:
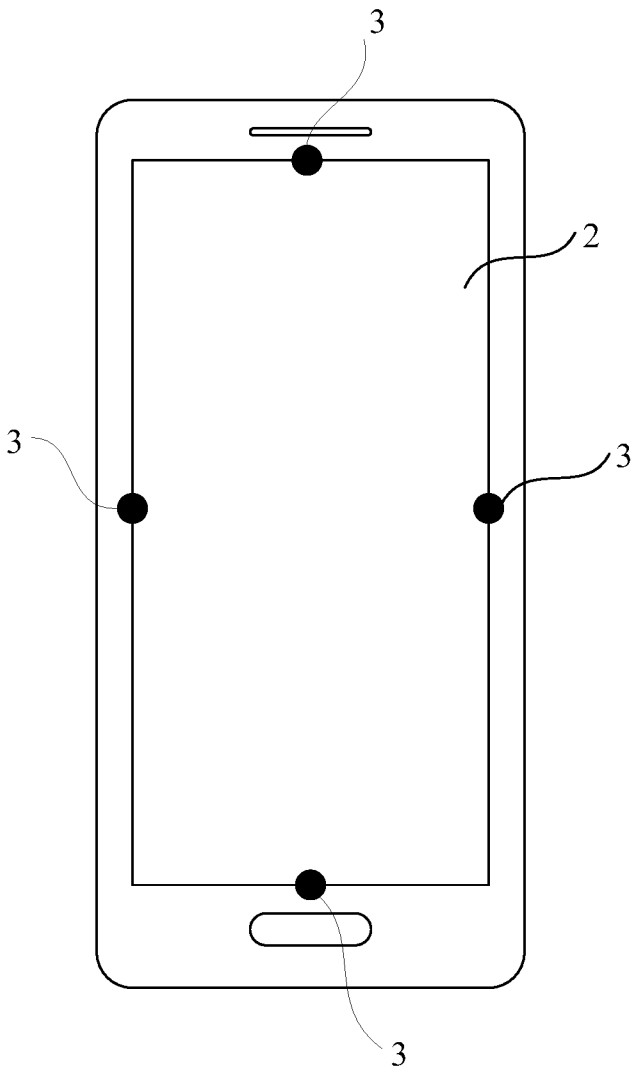
FIG. 2*b* is a structure diagram of a terminal device including a display panel provided by the embodiments of the present disclosure.
Figure 2C:
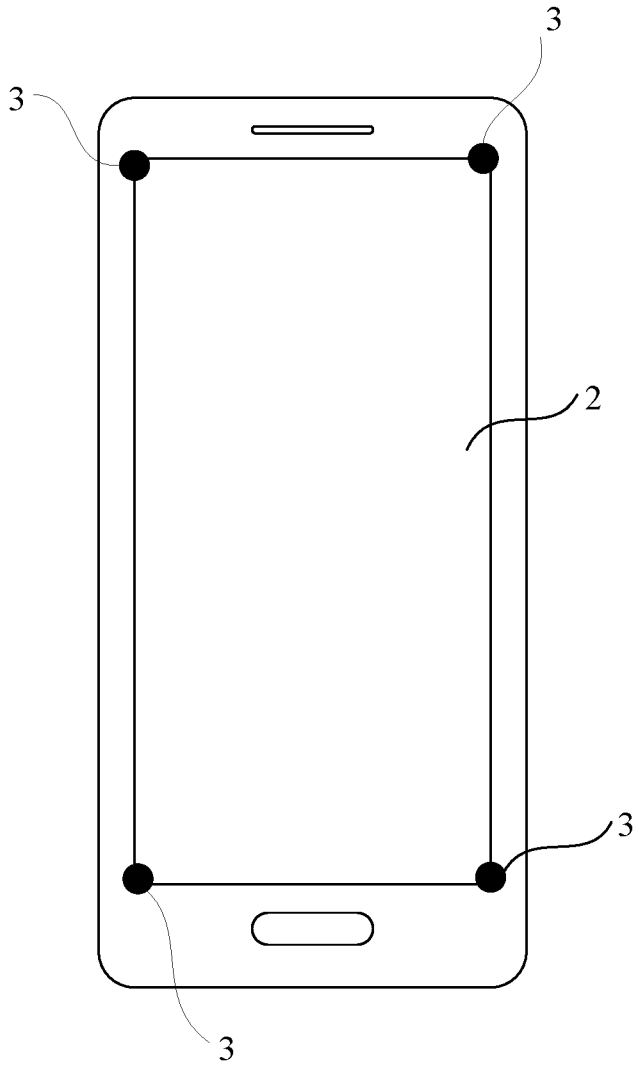
FIG. 2*c* is a structure diagram of another terminal device including a display panel provided by the embodiments of the present disclosure.

Optionally, the number of the photosensitive elements is four, and reference is made to FIG. 2B, which is a structure diagram of a terminal device including a display panel provided by the embodiments of the present disclosure. The photosensitive elements 3 are provided on the four edges of the rectangular display panel 2, respectively, or referring to FIG. 2C, which is a structure diagram of another terminal device including a display panel provided by the embodiments of the present disclosure, and the photosensitive elements 3 are provided on the four corners of the display panel 2, respectively, or the photosensitive elements 3 may be arbitrarily disposed at the edges of the display panel 2, or the display panel 2 may have other shapes, and the photosensitive elements 3 may be provided in a regular or irregular order at the edges of the display panel 2.

In step S220, the maximum and minimum values of the display brightness are respectively transmitted to the system board or the control board, so that the system board or the control panel obtains a plurality of sets of measured contrast values based on the maximum and minimum values of the plurality of sets of the display brightness, and the plurality of sets of measured contrast values are averaged to obtain the contrast.

Each photosensitive element may output the measured maximum and minimum values of the display brightness to the system board or control board, and the system board or control panel calculates the contrast according to the maximum and minimum values of the display brightness. The system board or the control panel may obtain N measured contrast values of the display brightness according to the N sets of the maximum and minimum values of the display brightness of the photosensitive elements, and then the N measured contrast values are averaged to obtain the contrast, for example, two photosensitive elements M1 and M2 are provided, the maximum and minimum values of the display brightness measured by the photosensitive element M1 are H1 and L1, respectively, and the system board or control panel acquires the measured contrast value D1 from the formula H1/L1; the maximum and minimum values of the display brightness measured by the photosensitive element M2 are H2 and L2, respectively, and the system board or control panel acquires the measured contrast value D2 from the formula H2/L2. The system board or control panel then acquires the contrast value D from the formula (D1+D2)/2.

Alternatively, the contrast may be obtained directly from the data measured by one of the photosensitive elements, and the contrast may then be verified by the data measured by the other photosensitive elements. By way of example, the system board or the control panel obtains the contrast D from the data measured by the photosensitive element M1, and the contrast D1 is then measured by the photosensitive element M2. If the difference between the contrast D1 and the contrast D is greater than the set range, the photosensitive element is re-controlled to perform the measurement of the display brightness.

In addition, it is also possible to firstly obtain the maximum values of the display brightness measured by the plurality of photosensitive elements, and to obtain the average value thereof, similarly, to obtain the minimum values of the display brightness measured by the plurality of photosensitive elements, and to obtain the average value thereof, the contrast of the display brightness is then obtained by taking average of the average value of the maximum values and the average value of the minimum. By way of example, two photosensitive elements M1 and M2 are provided, the maximum values H1 and H2 of the measured display brightness are obtained respectively, and the average value H of the maximum values of the display brightness is obtained through the formula (H1+H2)/2, similarly, the average value L of the minimum values of the display brightness is obtained, and the contrast is then obtained according to the formula H/L.

In step S230, the contrast is compared with the initial contrast, and if the difference between the contrast and the initial contrast is greater than the set threshold, the gate-off voltage of the display panel is gradually increased with the set value based on the initial gate-off voltage.

It is possible to set the set value as the increment of the gate-off voltage when the difference between the measured contrast and the initial contrast is greater than the set threshold, where the set value may be a fixed value. The set value should be as small as possible to ensure that the state in which the contrast becomes the initial contrast will not be missed when the gate-off voltage is adjusted. When the difference between the current contrast and the initial contrast is detected to be greater than the set threshold value, the set value is increased on the basis of the initial gate-off voltage, and then the current contrast is detected again, and to determine whether the difference between the current contrast and the initial contrast are greater than the set threshold value, if the difference is greater than the set threshold value, the set value is increased on the basis of the last gate-off voltage, that is, the set value is incremented until the difference between the current contrast and the initial contrast is smaller than the set threshold value.

The method for adjusting the gate-off voltage in the present scheme acquiring the contrast of the display brightness of the display panel through the plurality of photosensitive elements, to enhance the accuracy of the measured results. Furthermore, the contrast of the display panel display brightness is measured and compared with the initial contrast for many times, each time when the difference between each contrast and the initial contrast is greater than the set threshold value, the initial gate-off voltage is served as the basis and is increased with the set value until the difference between the contrast and the initial contrast is less than the set threshold value. The logic of the present scheme is simple and easy to be programmed, and the gate-off voltage may be adjusted accurately.

Figure 3A:
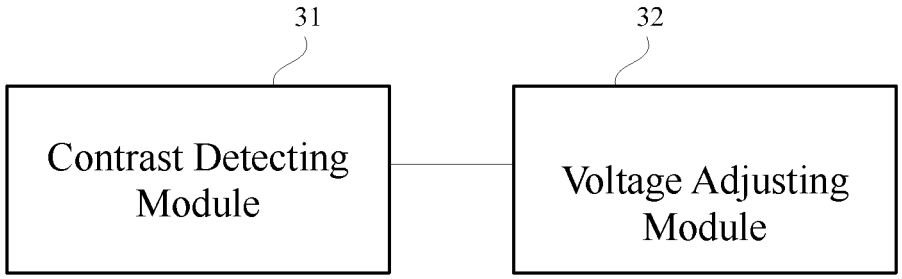
FIG. 3*a* is a structure diagram of a device for adjusting the gate-off voltage provided by the embodiments of the present disclosure.

The embodiments of the present disclosure also provide a device for adjusting the gate-off voltage, referring to FIG. 3*a*, which is a structure diagram of a device for adjusting the gate-off voltage provided by the embodiments of the present disclosure, and the device for adjusting the gate-off voltage provided by the present embodiment includes: a contrast detecting module 31 and a voltage adjusting module 32.

In this case, the contrast detecting module 31 is arranged to obtain the contrast of the display brightness of the display panel by at least one photosensitive element;

the voltage adjusting module 32 is connected to the contrast detecting module 31, arranged to compare the contrast with an initial contrast, if a difference between the contrast and the initial contrast is greater than a set threshold value, the contrast detecting module is configured to adjust the gate-off voltage of the display panel.

In the device for adjusting the gate-off voltage provided by the embodiment of the present disclosure, the contrast detecting module 31 acquires the contrast of the display brightness of the display panel by the at least one photosensitive element, the voltage adjusting module 32 compares the contrast with the initial contrast of the display panel, and if the difference between the contrast and the initial contrast is greater than the set threshold, the gate-off voltage of the display panel is adjusted. It is possible to solve the problem that the pixel display of the display panel is not completely turned off as the working time passes, resulting in a decrease in the display contrast of the pixels in the display area.

On the basis of the embodiment described above, optionally, the photosensitive element may be a photosensitive resistor, a photosensitive optical fiber or an optical lens.

Figure 3B:
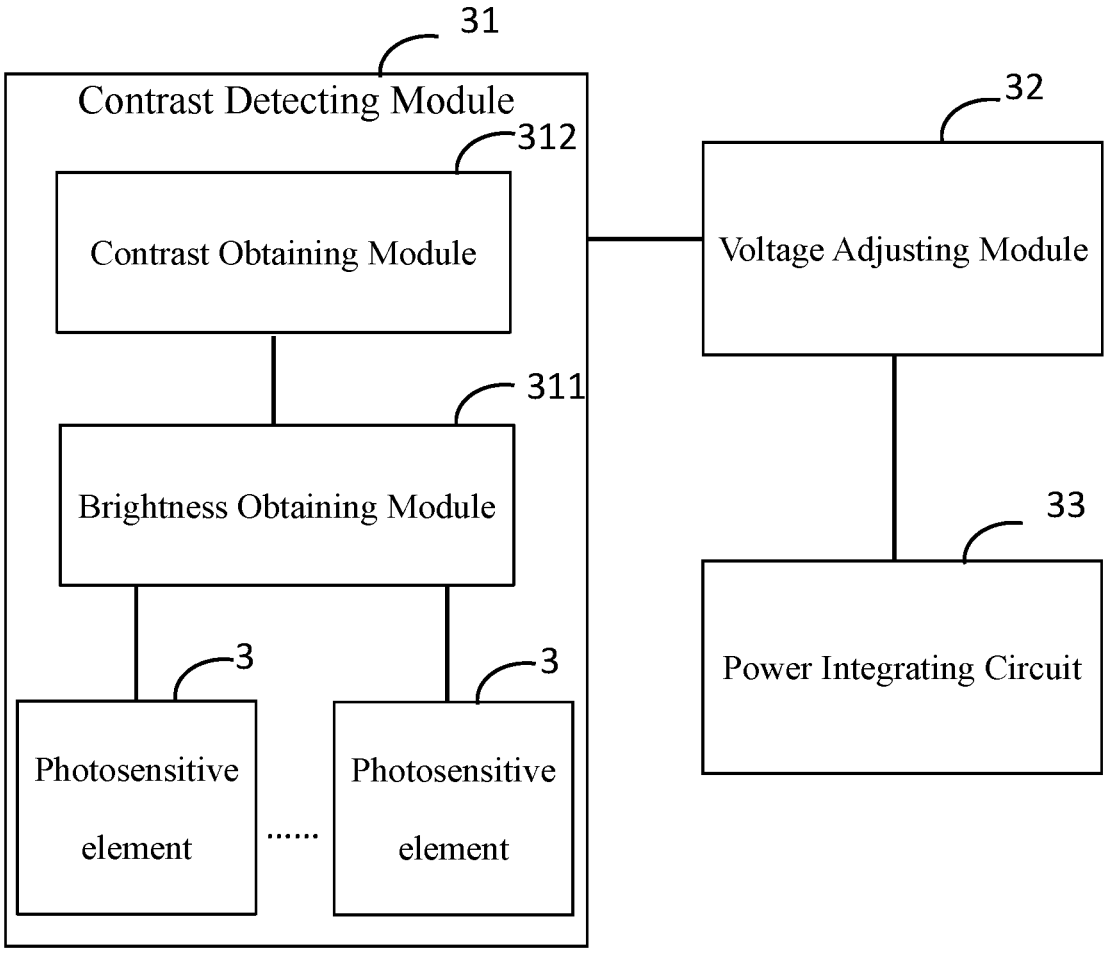
FIG. 3*b* is a structure diagram of another device for adjusting the gate-off voltage provided by the embodiments of the present disclosure.

Optionally, referring to FIG. 3*b*, which is a structure diagram of another device for adjusting the gate-off voltage provided by the embodiments of the present disclosure, the device may further include a power integrating circuit 33 connected to the voltage adjusting module 32 for generating an initial gate-off voltage, such that the voltage adjusting module 32 adjusts the gate-off voltage on the basis of the initial gate-off voltage.

Optionally, the number of the photosensitive element may be four, and the photosensitive elements may be disposed on the four edges of the rectangular display panel, respectively, or may be disposed at four corners of the rectangular display panel, respectively.

Alternatively, the contrast detecting module 31 may include a plurality of photosensitive elements 4 disposed on the edge of the display panel;

the contrast detecting module 31 may further include:

the brightness obtaining unit 311 connected to the plurality of photosensitive elements 3 and is arranged to obtain a maximum value and a minimum value of the display brightness of the display panel by the plurality of photosensitive elements 3, respectively;

the contrast obtaining unit 312 connected to the brightness obtaining unit 311 and is configured to transmit the maximum and minimum values of the display brightness to the system board or the control board, respectively, so that the system board or the control panel is configured to obtain a plurality of sets of contrast measurement values according to the plurality of sets of the maximum and minimum values of the display brightness, and the contrast is then obtained by averaging the plurality of sets of contrast measurement values.

The system board or the control board is a processor of the terminal device, which may receive the maximum and minimum values of the display brightness transmitted by the contrast obtaining unit 312 in the device for adjusting the gate-off voltage, and obtains the contrast of the display brightness of the display panel from the logically calculation, and then transmits the contrast to the contrast obtaining unit 312.

Optionally, the voltage adjusting module 32 may be configured to: compare the contrast with an initial contrast, and when the difference between the contrast and the initial contrast is greater than a set threshold value, the voltage adjusting module configured to adjust the gate-off voltage of the display panel by gradually increasing the set value on the basis of the initial gate-off voltage.

The device for adjusting the gate-off voltage in the present scheme acquiring the contrast of the display brightness of the display panel through the plurality of photosensitive elements, to enhance the accuracy of the measured results. Furthermore, the contrast of the display panel display brightness is measured and compared with the initial contrast for many times, each time when the difference between each contrast and the initial contrast is greater than the set threshold value, the initial gate-off voltage is served as the basis and is increased with the set value until the difference between the contrast and the initial contrast is less than the set threshold value. The logic of the present scheme is simple and easy to be programmed, and the gate-off voltage may be adjusted accurately.

Figure 4:
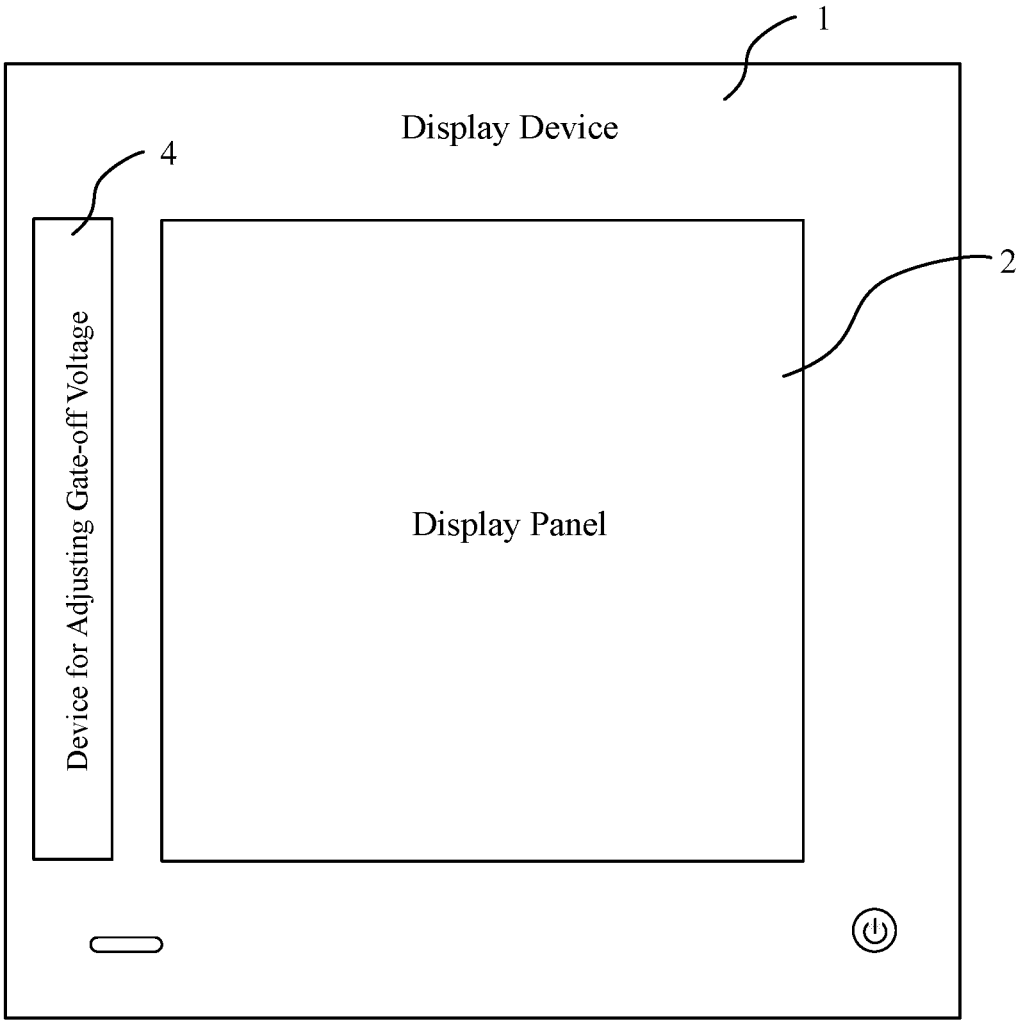
FIG. 4 is a structure diagram of a display apparatus provided by the embodiments of the present disclosure.

The embodiment of the present disclosure also provides a display device, referring to FIG. 4, which is a structure diagram of a display apparatus provided by the embodiments of the present disclosure, the display apparatus 1 includes a display panel 2, and the device for adjusting the gate-off voltage 4 described in any of the embodiments of the present disclosure.

The embodiment of the present disclosure further provides a method for adjusting the display panel, the display panel includes a thin film transistor, a gate of the thin film transistor receives a first voltage signal, the method for adjusting the display panel includes:

acquiring a maximum brightness value and the minimum brightness value of the display panel at a first time by a photosensitive element, and calculating a contrast of the first time based on the maximum brightness value and the minimum brightness value at the first time;

acquiring a maximum brightness value and the minimum brightness value of the display panel at a second time by the photosensitive element, and calculating a contrast of the second time based on the maximum brightness value and the minimum brightness value at the second time;

calculating a difference between the contrast of the second time and the contrast of the first time;

calculating a first increment based on the difference between the contrast of the second time and the contrast of the first time; and adding the first voltage signal with the first increment.

Optionally, the photosensitive element is a photoresistor, a photosensitive optical fiber or an optical lens.

Optionally, the number of the photosensitive elements is at least four, and the photosensitive elements are disposed on four edges of the rectangular display panel, or at four corners of the rectangular display panel, respectively.

Optionally, the second time is after the first time, and a time interval between the second time and the first time is 6 hours.

It is noted that the above description is only a preferred embodiment of the present disclosure and the preferred technical principles are utilized therein. It will be understood by those skilled in the art that the present disclosure is not limited to the specific embodiments described herein and that various changes, modifications and substitutions will be made by those skilled in the art without departing from the scope of the present disclosure. Accordingly, although the present disclosure has been described in more detail by way of the above examples, the present disclosure is not limited to the above embodiments, and other equivalent embodiments may be included without departing from the spirit of the present disclosure, which is determined by the scope of the appended claims.

What is claimed is:

1. A method for adjusting a gate-off voltage, comprising:

obtaining a display brightness of a display panel by at least one photosensitive element to obtain a contrast of the display brightness of the display panel by a contrast detecting module; and comparing the contrast with an initial contrast, and adjusting the gate-off voltage of the display panel by a voltage adjusting module if the difference between the contrast and the initial contrast is greater than the set threshold;

wherein the photosensitive elements are plural;

wherein the step of obtaining the contrast of the display brightness of the display panel by the at least one photosensitive element comprising:

obtaining maximum values and minimum values of display brightness of the display panel by a plurality of photosensitive elements disposed at edges of the display panel;

transmitting the maximum value and the minimum value of the display brightness to a system board or a control board by the contrast detecting module, such that the system board or the control panel obtaining a plurality of sets of contrast measurement values based on the maximum value and minimum value of the plurality of sets of the display brightness, and averaging the plurality of sets of contrast measurement values to generate the contrast.

2. The method of claim 1, wherein a number of the photosensitive elements are at least four, and the photosensitive elements are disposed on four edges of a rectangular display panel, or at four corners of a rectangular display panel, respectively.

3. The method of claim 1, wherein the step of comparing the contrast with the initial contrast, and adjusting the gate-off voltage of the display panel if the difference between the contrast and the initial contrast is greater than the set threshold comprising:

comparing the contrast with the initial contrast, and each time when the difference between the contrast and the initial contrast is greater than the set threshold value, increasing the gate-off voltage of the display panel on a basis of the initial gate-off voltage with a set value.

4. A device for adjusting a gate-off voltage comprising:

a contrast detecting module including at least one photosensitive element, and obtaining a contrast based on a display brightness of a display panel obtained by the photosensitive element;

a voltage adjusting module connected to the contrast detecting module, and comparing the contrast with an initial contrast, if the difference between the contrast and the initial contrast is greater than a set threshold value, the voltage adjusting module adjusting the gate-off voltage of the display panel;

wherein the contrast detecting module includes a plurality of photosensitive elements arranged at an edge of the display panel;

wherein the contrast detecting module further comprises:

a brightness obtaining unit connecting to the plurality of photosensitive elements and configuring to obtain maximum values and minimum values of the display brightness of the display panel by the plurality of the photosensitive elements, respectively; and a contrast obtaining unit connecting to the brightness obtaining unit for transmitting the maximum value and the minimum value of the display brightness to a system board or a control board, respectively, such that the system board or the control panel obtains a plurality of sets of contrast measurement values based on the maximum values and minimum values of the plurality of sets of the display brightness and obtains the contrast by averaging the plurality of sets of contrast measurement values.

5. The device of claim 4, wherein the photosensitive element is a photosensitive resistor.

6. The device of claim 4, further comprising:

a power integrating circuit connected to the voltage adjusting module and generating an initial gate-off voltage, such that the voltage adjusting module adjusting the gate-off voltage on a basis of the initial gate-off voltage.

7. The device of claim 5, wherein a number of the photosensitive element is four, and the photosensitive elements are disposed on four edges of a rectangular display panel, or at four corners of a rectangular display panel, respectively.

8. The device of claim 4, wherein the voltage adjusting module compares the contrast with an initial contrast, and each time when the difference between the contrast and the initial contrast is greater than a set threshold value, the voltage adjusting module increases the gate-off voltage of the display panel on the basis of an initial gate-off voltage with a set value.

9. A display apparatus, comprising a display panel and the device for adjusting the gate-off voltage of claim 4.

10. The display apparatus of claim 9, wherein the photosensitive element is a photosensitive resistor, a photosensitive optical fiber or an optical lens.

11. The display apparatus of claim 9, wherein the device for adjusting the gate-off voltage further comprises:

a power integrating circuit connecting to the voltage adjusting module and configuring to generate an initial gate-off voltage, such that the voltage adjusting module adjusts the gate-off voltage on the basis of the initial gate-off voltage.

12. The display apparatus of claim 9, wherein a number of the photosensitive members is four, and the photosensitive elements are disposed on four edges of a rectangular display panel, or at four corners of a rectangular display panel, respectively.

13. The display apparatus of claim 9, wherein the contrast detecting module comprises a plurality of photosensitive elements disposed at an edge of the display panel; and wherein the contrast detecting module further comprises:

a brightness obtaining unit connecting to the plurality of photosensitive elements and configuring to obtain maximum values and minimum values of the display brightness of the display panel by the plurality of the photosensitive elements, respectively;

a contrast obtaining unit connected to the brightness obtaining unit for transmitting the maximum values and the minimum values of the display brightness to the system board or the control board, respectively, such that the system board or the control panel obtains a plurality of sets of contrast measurement values based on the plurality of sets of the display brightness, and the contrast is obtained by averaging the plurality of sets of contrast measurement values.

14. The display apparatus of claim 9, wherein the voltage adjusting module compares the contrast with an initial contrast, and each time when the difference between the contrast and the initial contrast is greater than a set threshold value, the gate-off voltage of the display panel is increased on the basis of the initial gate-off voltage with a set value.

15. A method for adjusting a display panel, the display panel includes a thin film transistor, a gate of the thin film transistor receives a first voltage signal, the method for adjusting the display panel comprising:

obtaining a maximum brightness value and a minimum brightness value of the display panel at a first time by a photosensitive element, and calculating a contrast of the first time based on the maximum brightness value and the minimum brightness value at the first time by a contrast detecting module;

obtaining a maximum brightness value and a minimum brightness value of the display panel at a second time by the photosensitive element, and calculating a contrast of the second time based on the maximum brightness value and the minimum brightness value at the second time by the contrast detecting module;

calculating a difference between the contrast of the second time and the contrast of the first time obtained from the contrast detecting module by a voltage adjusting module;

calculating a first increment based on the difference between the contrast of the second time and the contrast of the first time by the voltage adjusting module; and adding the first voltage signal with the first increment by the voltage adjusting module.

16. The method of claim 15, wherein the photosensitive element is a photoresistor, a photosensitive optical fiber or an optical lens.

17. The method of claim 15, wherein a number of the photosensitive elements is at least four, and the photosensitive elements are disposed on four edges of a rectangular display panel, or at four corners of a rectangular display panel, respectively.

18. The method of claim 15, wherein the second time is after the first time, and a time interval between the second time and the first time is 6 hours.

* * * * *